US010638252B1

(12) United States Patent
Donley et al.

(10) Patent No.: US 10,638,252 B1
(45) Date of Patent: Apr. 28, 2020

(54) DYNAMIC ADJUSTMENT OF SIGNAL ENHANCEMENT FILTERS FOR A MICROPHONE ARRAY

(71) Applicant: Facebook Technologies, LLC, Menlo Park, CA (US)

(72) Inventors: Jacob Ryan Donley, Redmond, WA (US); Vladimir Tourbabin, Sammamish, WA (US); Ravish Mehra, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/417,196

(22) Filed: May 20, 2019

(51) Int. Cl.

| | |
|---|---|
| ***H04S 7/00*** | (2006.01) |
| ***H04R 5/04*** | (2006.01) |
| ***H04R 5/027*** | (2006.01) |
| ***H04R 3/04*** | (2006.01) |
| ***H04R 5/033*** | (2006.01) |

(52) U.S. Cl.
CPC ..... *H04S 7/307* (2013.01); *H04R 3/04* (2013.01); *H04R 5/027* (2013.01); *H04R 5/033* (2013.01); *H04R 5/04* (2013.01); *H04S 2420/01* (2013.01)

(58) Field of Classification Search
CPC .. H04S 7/307; H04S 2420/01; H04S 2400/11; H04R 3/04; H04R 5/027; H04R 5/033; H04R 5/04; H04R 2460/07; H04R 2499/15; G10L 21/28; G10L 21/0232; G10L 25/21; G10L 2021/02166
USPC ..... 381/300, 13, 303, 26, 56–59, 317, 71.1, 381/71.11, 73.1, 74, 94.1, 89–99, 122
See application file for complete search history.

(56) References Cited

U.S. PATENT DOCUMENTS

2009/0198495 A1* 8/2009 Hata ..... G10L 15/04 704/246
2011/0013075 A1* 1/2011 Kim ..... H04N 5/602 348/370

* cited by examiner

*Primary Examiner* — Norman Yu
(74) *Attorney, Agent, or Firm* — Fenwick & West LLP

(57) ABSTRACT

An audio assembly includes a microphone assembly, a controller, and a speaker assembly. The microphone assembly detects audio signals. The detected audio signals originate from audio sources located within a local area. Each audio source is associated with a respective beamforming filter. The controller determines beamformed data using the beamforming filters associated with each audio source and a relative contribution of each of the audio sources using the beamformed data. The controller generates updated beamforming filters for each of the audio sources based in part on the relative acoustic contribution of the audio source, a current location of the audio source, and a transfer function associated with audio signals produced by the audio source. The controller generates updated beamformed data using the updated beamforming filters and performs an action (e.g., via the speaker assembly) based in part on the updated beamformed data.

20 Claims, 5 Drawing Sheets

DYNAMIC ADJUSTMENT OF SIGNAL ENHANCEMENT FILTERS FOR A MICROPHONE ARRAY

BACKGROUND

This disclosure relates generally to signal enhancement filters and specifically to adapting updating signal enhancement filters.

Conventional signal enhancement algorithms operate under certain assumptions, for example knowledge of a layout of an environment surrounding an audio assembly and one or more audio sources, the layout of the environment doesn't change over a period of time, and statistics describing certain acoustic attributes are already available to be determined. However, in most practical applications the layout of the environment is dynamic with regards to the position of audio sources and devices that receive signals from those audio sources. Additionally, given the dynamically changing nature of audio sources in most environments, noisy signals received from the audio sources often need to be enhanced by signal enhancement algorithms.

SUMMARY

An audio assembly dynamically adjusts beam forming filters for a microphone array (e.g., of an artificial reality headset). The audio assembly may include a microphone array, a speaker assembly, and a controller. The microphone array detects audio signals originating from one or more audio sources within a local area. The controller generates updated enhanced signal data for each of the one or more audio sources using signal enhancement filters. The speaker assembly performs an action, for example presenting content to the user operating the audio assembly, based in part on the updated enhanced signal data.

In some embodiments, the audio assembly includes a microphone assembly, a controller, and a speaker assembly. The microphone assembly is configured to detect audio signals with a microphone array. The audio signals originate from one or more audio sources located within a local area, and each audio source is associated with a set of respective signal enhancement filters to enhance audio signals from a set of microphones. In some embodiments, an audio signal is processed using one of a variety of signal enhancement processes, for example a filter and sum process. The controller is configured to determine enhanced signal data using the signal enhancement filters associated with each audio source. The controller is configured to determine a relative acoustic contribution of each of the one or more audio sources using the enhanced signal data. The controller is configured to generate updated signal enhancement filters for each of the one or more audio sources. The generation for each audio source based in part on an estimate of the relative acoustic contribution of the audio source, an estimate of a current location of the audio source, and an estimate of a transfer function associated with audio signals produced by the audio source. In some embodiments, the relative acoustic contribution, the current location, and the transfer function may be characterized by exact values, but they may alternatively be estimated values. The controller is configured to generate updated signal enhancement data using the updated signal enhancement filters. The speaker assembly is configured to perform an action based in part on the updated enhanced signal data. In some embodiments, the audio assembly may be a part of a headset (e.g., an artificial reality headset).

In some embodiments, a method is described. The method comprises detecting audio signals with a microphone array, and the audio signals originate from one or more audio sources located within a local area. Enhanced signal data is determined using the signal enhancement filters associated with each audio source. A relative acoustic contribution of each of the one or more audio sources is determined using the enhanced signal data. An updated signal enhancement filter for each of the one or more audio sources is generated. And the generation for each audio source is based in part on the relative acoustic contribution of the audio source, a current location of the audio source, and a transfer function associated with audio signals produced by the audio source. Updated enhanced signal data is generated using the updated signal enhancement filters. An action is performed based in part on the updated enhanced signal data.

Figure 1:
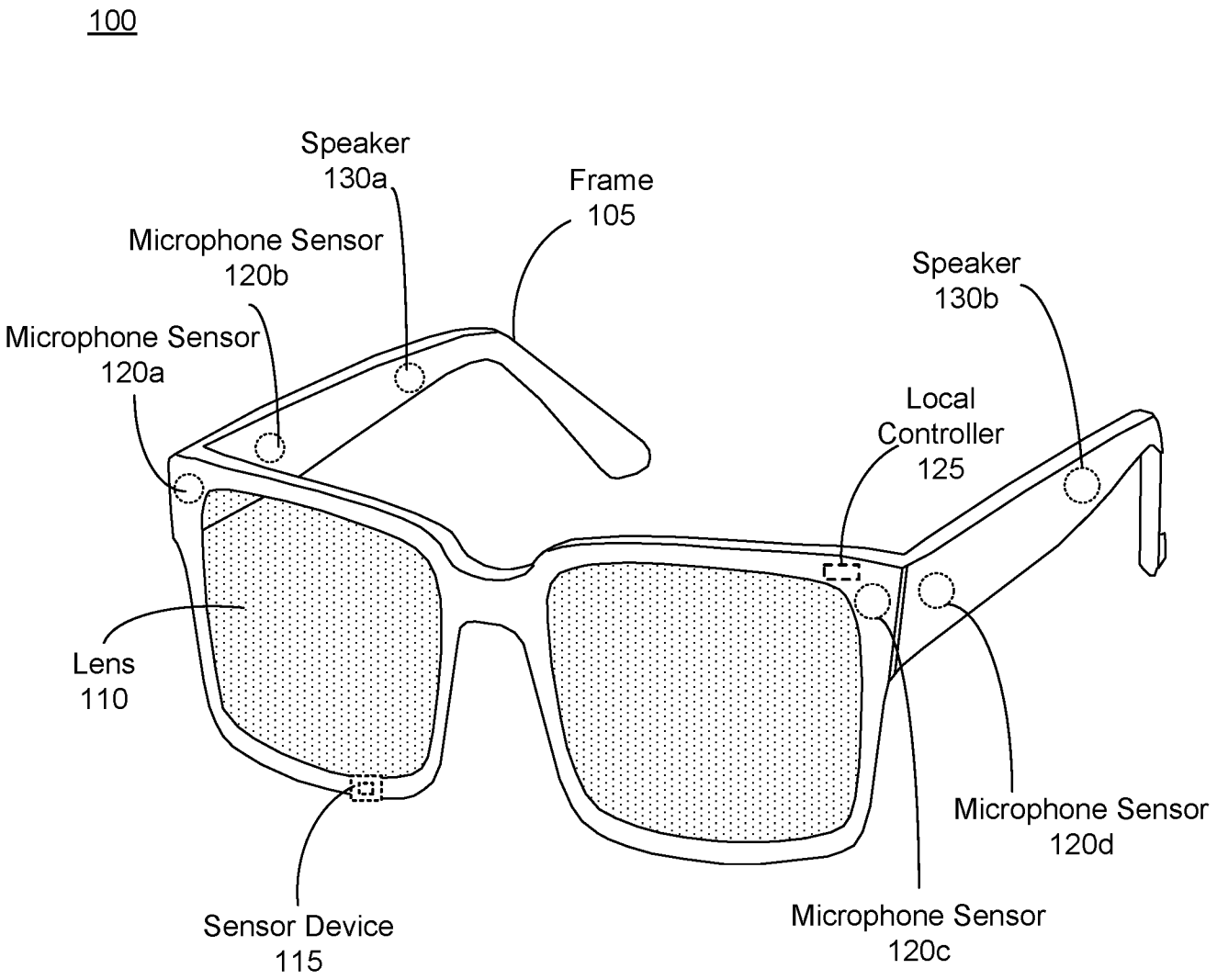
FIG. 1 is an example diagram illustrating a headset including an audio assembly, according to one or more embodiments.

The figures depict various embodiments of the present disclosure for purposes of illustration only. One skilled in the art will readily recognize from the following discussion that alternative embodiments of the structures and methods illustrated herein may be employed without departing from the principles, or benefits touted, of the disclosure described herein.

DETAILED DESCRIPTION

Configuration Overview

An audio assembly updates signal enhancement filters in environments in which a microphone array embedded into the audio assembly and at least one audio source which may be moving relative to each other. The audio assembly is configured to include a microphone array, a controller, and a speaker assembly, all of which may be components of headsets (e.g., near-eye displays, head-mounted displays) worn by a user. The audio assembly detects an audio signal using one or more microphone arrays. An audio source, which may be a person in the environment different from the user operating the audio assembly, a speaker, an animal, or a mechanical device emits a sound near the user operating the assembly. In addition to those described above, an acoustic sound source may be any other sound source. The embedded microphone array detects the sound emitted. Additionally, the microphone array may record the detected sound and store the recording for subsequent processing and analysis of the sound.

Depending on its position, an audio assembly may be surrounded by multiple audio sources which collectively produce sounds that may be incoherent when listened to all at once. Among these audio sources, a user of the audio assembly may want to tune into a particular audio source. Typically, the audio source that the user 165 wants to tune into may need to be enhanced to distinguish its audio signal from the signals of other audio sources. Additionally, at a first timestamp, an audio signal emitted from an audio source may travel directly to a user, but at a second timestamp, the same audio source may change position and an audio signal emitted from the source and may travel a longer distance to the user. At the first timestamp, the audio assembly may not need to enhance the signal, but at the second timestamp, the audio assembly may need to enhance the signal. Hence, embodiments described herein adaptively generate signal enhancement filters to reflect the most recent position of each audio source in the surrounding environment. As referenced herein, the environment surrounding a user and a local area surrounding an audio assembly operated by the user are referenced synonymously.

Depending on its position, an audio assembly may receive audio signals from various directions of arrival at various levels of strength, for example audio signals may travel directly from an audio source to the audio assembly or reflect off of surfaces within the environment. Audio signals reflecting off of surfaces may resultantly experience decreases in their signal strengths. Accordingly, the audio assembly may need to perform signal enhancement techniques to improve the strength of such signals. Additionally, given that the position of audio sources may change over time, the strength of signals emitted by the audio sources at each time may also vary. Accordingly, the signal enhancement filter may be updated to accommodate the strength of the emitted signal at each position.

At a first timestamp, an initial use of the audio assembly, or both, the controller determines enhanced signal data using the signal enhancement filters associated with each audio source and determines a relative acoustic contribution of each of the one or more audio sources using the enhanced signal data. At a second timestamp during which each audio source may have adjusted their position, the controller generates updated signal enhancement filters for each audio source based on one or more of the relative acoustic contribution of each audio source, a current location of the audio source, and a transfer function associated with audio signals produced by the audio source. The controller generates updated enhanced signal data using the updated signal enhancement filters. Based in part on the enhanced signal data, a speaker assembly performs an action.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a HMD connected to a host computer system, a standalone HMD, a mobile device or computing system, or any other hardware platform capable of providing artificial reality content to one or more viewers.

Headset Configuration

FIG. 1 is an example diagram illustrating a headset 100 including an audio assembly, according to one or more embodiments. The headset 100 presents media to a user. In one embodiment, the headset 100 may be a near-eye display (NED). In another embodiment, the headset 100 may be a head-mounted display (HMD). In general, the headset may be worn on the face of a user such that content (e.g., media content) is presented using one or both lens 110 of the headset. However, the headset 100 may also be used such that media content is presented to a user in a different manner. Examples of media content presented by the headset 100 include one or more images, video, audio, or some combination thereof. The headset 100 includes the audio assembly, and may include, among other components, a frame 105, a lens 110, and a sensor device 115. While FIG. 1 illustrates the components of the headset 100 in example locations on the headset 100, the components may be located elsewhere on the headset 100, on a peripheral device paired with the headset 100, or some combination thereof.

The headset 100 may correct or enhance the vision of a user, protect the eye of a user, or provide images to a user. The headset 100 may be eyeglasses which correct for defects in a user's eyesight. The headset 100 may be sunglasses which protect a user's eye from the sun. The headset 100 may be safety glasses which protect a user's eye from impact. The headset 100 may be a night vision device or infrared goggles to enhance a user's vision at night. The headset 100 may be a near-eye display that produces artificial reality content for the user. Alternatively, the headset 100 may not include a lens 110 and may be a frame 105 with an audio system that provides audio content (e.g., music, radio, podcasts) to a user.

The frame 105 includes a front part that holds the lens 110 and end pieces to attach to the user. The front part of the frame 105 bridges the top of a nose of the user. The end pieces (e.g., temples) are portions of the frame 105 that hold the headset 100 in place on a user (e.g., each end piece extends over a corresponding ear of the user). The length of the end piece may be adjustable to fit different users. The end piece may also include a portion that curls behind the ear of the user (e.g., temple tip, ear piece).

The lens 110 provides or transmits light to a user wearing the headset 100. The lens 110 may be prescription lens (e.g., single vision, bifocal and trifocal, or progressive) to help correct for defects in a user's eyesight. The prescription lens transmits ambient light to the user wearing the headset 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional detail regarding the lens 110 is discussed with regards to FIG. 5. The lens 110 is held by a front part of the frame 105 of the headset 100.

In some embodiments, the headset 100 may include a depth camera assembly (DCA) (not shown) that captures data describing depth information for a local area surrounding the headset 100. In some embodiments, the DCA may include a light projector (e.g., structured light and/or flash illumination for time-of-flight), an imaging device, and a controller. The captured data may be images captured by the imaging device of light projected onto the local area by the light projector. In one embodiment, the DCA may include two or more cameras that are oriented to capture portions of the local area in stereo and a controller. The captured data may be images captured by the two or more cameras of the local area in stereo. The controller computes the depth information of the local area using the captured data and depth determination techniques (e.g., structured light, time-of-flight, stereo imaging, etc.). Based on the depth information, the controller determines absolute positional information of the headset 100 within the local area. In alternate embodiments, the controller may use the depth information and additional imaging capabilities to segment and localize particular objects in an environment, for example human speakers. Such objects may be used as additional inputs to an adaptive algorithm, for example to enhance the robustness of the acoustic directional tracking. The DCA may be integrated with the headset 100 or may be positioned within the local area external to the headset 100. In the latter embodiment, the controller of the DCA may transmit the depth information to the controller 125 of the headset 100. In addition, the sensor device 115 generates one or more measurements signals in response to motion of the headset 100. The sensor device 115 may be location on a portion of the frame 105 of the headset 100.

The sensor device 115 may include a position sensor, an inertial measurement unit (IMU), or both. Some embodiments of the headset 100 may or may not include the sensor device 115 or may include more than one sensor device 115. In embodiments in which the sensor device 115 includes an IMU, the IMU generates IMU data based on measurement signals from the sensor device 115. Examples of sensor devices 115 include: one or more accelerometers, one or more gyroscopes, one or more magnetometers, another suitable type of sensor that detects motion, a type of sensor used for error correction of the IMU, or some combination thereof. The sensor device 115 may be located external to the IMU, internal to the IMU, or some combination thereof.

Based on the one or more measurement signals, the sensor device 115 estimates a current position of the headset 100 relative to an initial position of the headset 100. The estimated position may include a location of the headset 100 and/or an orientation of the headset 100 or the user's head wearing the headset 100, or some combination thereof. The orientation may correspond to a position of each ear relative to the reference point. In some embodiments, the sensor device 115 uses the depth information and/or the absolute positional information from a DCA to estimate the current position of the headset 100. The sensor device 115 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 100 from the sampled data. For example, the IMU integrates the measurement signals received from the accelerometers over time to estimate a velocity vector and integrates the velocity vector over time to determine an estimated position of a reference point on the headset 100. Alternatively, the IMU provides the sampled measurement signals to the controller 125, which determines the fast calibration data. The reference point is a point that may be used to describe the position of the headset 100. While the reference point may generally be defined as a point in space, however, in practice the reference point is defined as a point within the headset 100

An audio assembly dynamically generates enhanced signal data by processing a detected audio signal using a signal enhancement filter. The audio assembly comprises a microphone array, a speaker assembly, a local controller 125. However, in other embodiments, the audio assembly may include different and/or additional components. Similarly, in some cases, functionality described with reference to the components of the audio assembly can be distributed among the components in a different manner than is described here. For example, a controller stored at a remote server or a wireless device may receive a detected audio signal from the microphone array to update one or more signal enhancement filters. Such a controller may be capable of the same or additional functionality as the local controller 125. An embodiment of such a controller is described below with reference to FIG. 3.

The microphone arrays detect audio signals within a local area of the headset 100 or the audio assembly embedded within the headset 100. A local area describes an environment surrounding the headset 100. For example, the local area may be a room that a user wearing the headset 100 is inside, or the user wearing the headset 100 may be outside and the local area is an outside area in which the microphone array is able to detect sounds. In an alternate embodiment, the local area may describe an area localized around the headset such that only audio signals in a proximity to the headset 100 are detected. The microphone array comprises at least one microphone sensor coupled to the headset 100 to capture sounds emitted from an audio source, for example the voice of a speaker. In one embodiment, the microphone array comprises multiple sensors, for example microphones, to detect one or more audio signals. Increasing the number of microphone sensors comprising the microphone array may improve the accuracy and signal to noise ratio of recordings recorded by the audio assembly, while also providing directional information describing the detected signal.

In the illustrated configuration, the microphone array comprises a plurality of microphone sensors coupled to the headset 100, for example microphone sensors 120*a*, 120*b*, 120*c*, 120*d*. The microphone sensors detect air pressure variations caused by a sound wave. Each microphone sensor is configured to detect sound and convert the detected sound into an electronic format (analog or digital). The microphone sensors may be acoustic wave sensors, microphones, sound transducers, or similar sensors that are suitable for detecting sounds. The microphone sensors may be embedded into the headset 100, be placed on the exterior of the headset, be separate from the headset 100 (e.g., part of some other device), or some combination thereof. For example, in FIG. 1, the microphone array includes four microphone sensors: microphone sensors 120*a*, 120*b*, 120*c*, 120*d* which are positioned at various locations on the frame 105. The configuration of the microphone sensors 120 of the microphone array may vary from the configuration described with reference to FIG. 1. The number and/or locations of microphone sensors may differ from what is shown in FIG. 1. For example, the number of microphone sensors may be increased to increase the amount of information collected from audio signals and the sensitivity and/or accuracy of the information. Alternatively, the number of microphone sensors may be decreased to decrease computing power requirements to process detected audio signals. The microphone sensors may be oriented such that the microphone array is able to detect sounds in a wide range of directions surrounding the user wearing the headset 100. Each detected sound may be associated with a frequency, an amplitude, a duration, or some combination thereof.

The local controller 125 determines enhanced signal data representing a detected signal based on the sounds recorded by the microphone sensors 120. The location controller 125 performs signal enhancement techniques to remove background noise from the recording of the audio signal. The location controller 125 may also communicate audio signals from one headset to another, for example from an audio assembly to a controller on a server. In embodiments in which the remote controller is stored independent of the audio assembly (not shown in FIG. 1) and updates signal enhancement filters for enhancing audio signals, the local controller 125 communicates detected audio signals to the remote controller. In alternate embodiments, the local controller 125 is capable of performing some, if not all, of the functionality of a remote controller.

In one embodiment, the local controller 125 generates updated signal enhancement filters for each of the one or more audio sources using the enhanced signal data and generates updated enhanced signal data using the updated signal enhancement filters. Accordingly, the local controller 125 may receive detections of audio signals from the microphone sensors 120. Updated signal enhancement filters reduce the background noise associated with a signal detection to enhance the clarity of a signal when presented to a user via the speaker assembly. The local controller 125 may also receive additional information to improve the accuracy of the updated signal enhancement filter, for example a number of audio sources in the surrounding environment, an estimate of each audio source's position relative to the audio assembly, an array transfer function (ATF) for each audio source, and a recording of the detected audio signal. The local controller 125 may process the received information and updated signal enhancement filter to generate updated enhanced signal data describing the position of an audio source and the strength of the audio signal. The generation of updated signal enhancement filters by a controller is further described with reference to FIG. 3.

The speaker assembly performs actions based on the updated enhanced signal data generated by the local controller 125. The speaker assembly comprises a plurality of speakers coupled to the headset 100 to present enhanced audio signals to a user operating the audio assembly. In the illustrated configuration, the speaker assembly comprises two speakers coupled to the headset 100, for example speakers 130*a* and 130*b*. Each speaker is a hardware component that reproduces a sound according to an output received from the local controller 125. The output is an electrical signal describing how to generate sound and, therefore, each speaker is configured to convert an enhanced audio signal from an electronic format (i.e., analog or digital) into a sound to be presented to the user. The speakers may be embedded into the headset 100, be placed on the exterior of the headset, be separated from the headset 100 (e.g., part of some other device), or some combination thereof. In some embodiments, the speaker assembly includes two speakers which are positioned such that they are located in a user's auditory canal. Alternatively, the speakers may be partially enclosed by an ear cover of an on-ear headphone that covers the entire ear. The configuration of the speakers may vary from the configuration described with reference to FIG. 1. The number and/or locations of microphone sensors may differ from what is shown in FIG. 1.

FIG. 1 illustrates a configuration in which an audio assembly is embedded into a NED worn by a user. In alternate embodiments, the audio assembly may be embedded into a head-mounted display (HMD) worn by a user. Although the description above discusses the audio assemblies as embedded into headsets worn by a user, it would be obvious to a person skilled in the art, that the audio assemblies could be embedded into different headsets which could be worn by users elsewhere or operated by users without being worn.

Audio Analysis System

Figure 2:
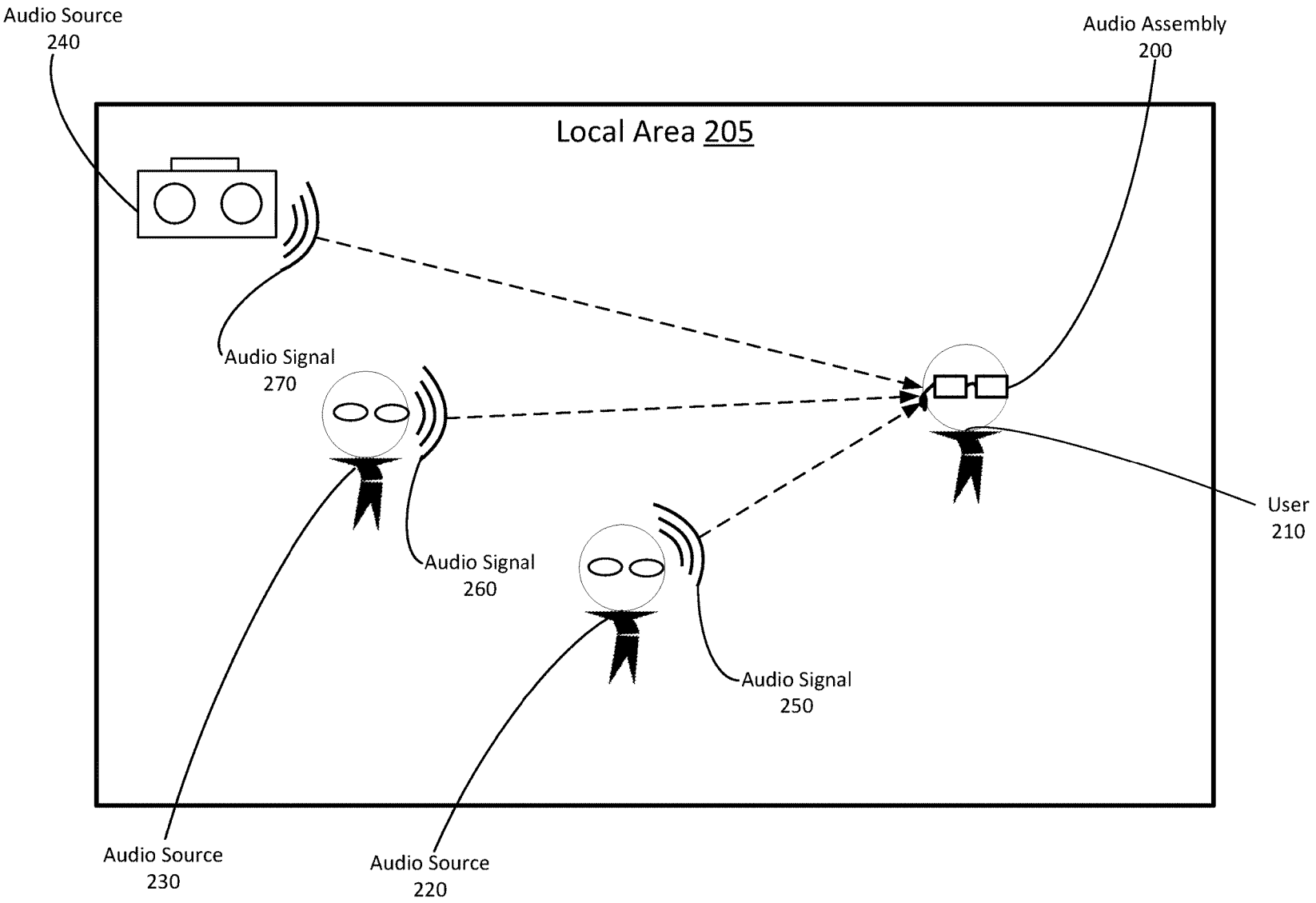
FIG. 2 illustrates an example audio assembly within a local area, according to one or more embodiments.

FIG. 2 illustrates an example audio assembly 200 within a local area 210, according to one or more embodiments. The local area 205 includes a user 210 operating the audio assembly 200, and three audio sources 220, 230, and 240. The audio source 220 (e.g., a person) emits an audio signal 250. A second audio source 230 (e.g., a second person), emits an audio signal 260. A third audio source 240 (e.g., an A/C unit or another audio source associated with background noise in the local area 205) emits an audio signal 270. In alternate embodiments, the user 210 and the audio sources 220, 230, and 240 may be positioned differently within the local area 205. In alternate embodiments, the local area 205 may include additional or fewer audio sources or users operating audio assemblies.

As illustrated in FIG. 2, the audio assembly 200 is surrounded by multiple audio sources 220, 230, and 240 which collectively produce audio signals which may vary in signal strength based on their position. In some embodiments, the audio assembly 200 classifies audio signals emitted by audio sources (i.e., audio sources 220, 230, and 240) based on predicted types of the one or more sound sources, for example as human type (e.g., a person in a local area communicating with a user of the audio assembly) or non-human type (e.g., an air-conditioning unit, a fan, etc.). The audio assembly 200 may only enhance audio signals categorized as human type, rather than also enhancing audio signals categorized as non-human type. Non-human noise signals which effectively distorts or reduces the strength of signals associated with human type need not be enhanced, compared to human type signals. In alternate embodiments, the audio assembly 200 may enhance audio signals categorized as non-human type depending on a set of conditions specified by a manual operator. For example, the audio assembly 200 may enhance audio signals characterizing the environment, for example music or bird cries, audio signals associated with user safety, for example emergency sirens, or other audio signals associated with sounds in which a user is interested in.

Depending on the type into which they are categorized by the audio assembly 200, signals received from each audio source may be enhanced to different degrees using different signal enhancement filters. For example, the audio source 220 and the audio source 230 may be users communicating with the user 210 operating the user assembly 200, categorized as human type audio. Accordingly, the audio assembly 200 enhances the audio signals 250 and 260 using signal enhancement techniques described below. In comparison, the audio source 240 is an air conditioning unit, categorized as non-human type audio. Accordingly, the audio assembly 200 identifies audio signal 270 as a signal which need not be enhanced.

More information regarding the categorization of audio signals by an audio assembly or a controller embedded thereon can be found in U.S. patent application Ser. No. 16/221,864, which is incorporated by reference herein in its entirety.

A microphone array of the audio assembly 200 detects each audio signal 250, 260, and 270 and records microphone signals of each detected audio signal. A controller of the audio assembly 200 generates an updated signal enhancement filter based on combination of a number of audio sources within the environment or local area of the audio assembly, a position of each audio source relative to the audio assembly, an ATF associated with each audio source, and the recorded microphone signal. The controller processes the recorded signal using the generated signal enhancement filter to generate enhanced signal data describing the audio signal which can be used to perform actions characterizing the environment in an artificial reality representation.

Recordings of an audio signal provide insight into how the layout and physical properties of the room affect sound propagation within the room. The room and objects in the room are composed of materials that have specific acoustic absorption properties that affect the room-impulse response. For example, a room composed of materials that absorb sound (e.g., a ceiling made of acoustic tiles and/or foam walls) will likely have a much different room impulse response than a room without those materials (e.g., a room with a plaster ceiling and concrete walls). Reverberations are much more likely to occur in the latter case as sound is not as readily absorbed by the room materials.

In one exemplary embodiment consistent with the local area illustrated in FIG. 2, the audio assembly 200 may detect audio signals 250, 260, and 270, but be interested in a particular audio signal out of audio signals 250, 260, and 270. For example, a user operating the audio assembly may be interacting with the users operating the audio sources 220 and 230 in a virtual reality representation of the local area 205 and therefore be particularly interested in the audio signals 250 and 260 emitted from the audio sources 220 and 230, but not interested in the audio signal 270 emitted by the audio source 240 (e.g., an AC unit, a fan, etc.). Accordingly, the audio assembly 200 enhances audio signals 250 and 260, but not the audio signal 270, thereby improving a quality of sound presented to the user 210.

The embodiments and implementations of the audio analysis system described above may be characterized as enhancement of audio signals for human consumption. In alternate embodiments, the audio analysis system 200 may be configured to enhance audio signals for machine perception. In such implementations, the audio assembly 200 may be used to enhance audio signals into automatic speech recognition (ASR) pipelines by separating audio signals from types of audio signals associated with noise, for example non-human type signals. The audio assembly 200 may suppress or remove noise or interfering sources, enhance or keep desired or wanted sound sources, or a combination thereof. In one embodiment, such processing is used for the real-time translation of multiple sources or languages or applications, for example multi-participant meeting transcription. Alternatively, such an audio assembly 200 may be implemented in environments with levels of noise above a threshold, for example restaurants, cafes, sporting events, markets, or other environments where conversations between human users may be difficult to discern due to loud noisy signals.

A process for generating updated enhanced signal data using updated signal enhancement filters is described with reference to FIG. 3-4. Based on the generated signal enhancement filter, the controller enhances audio signals to more accurately design a virtual representation of a user's environment or local area.

Figure 3:
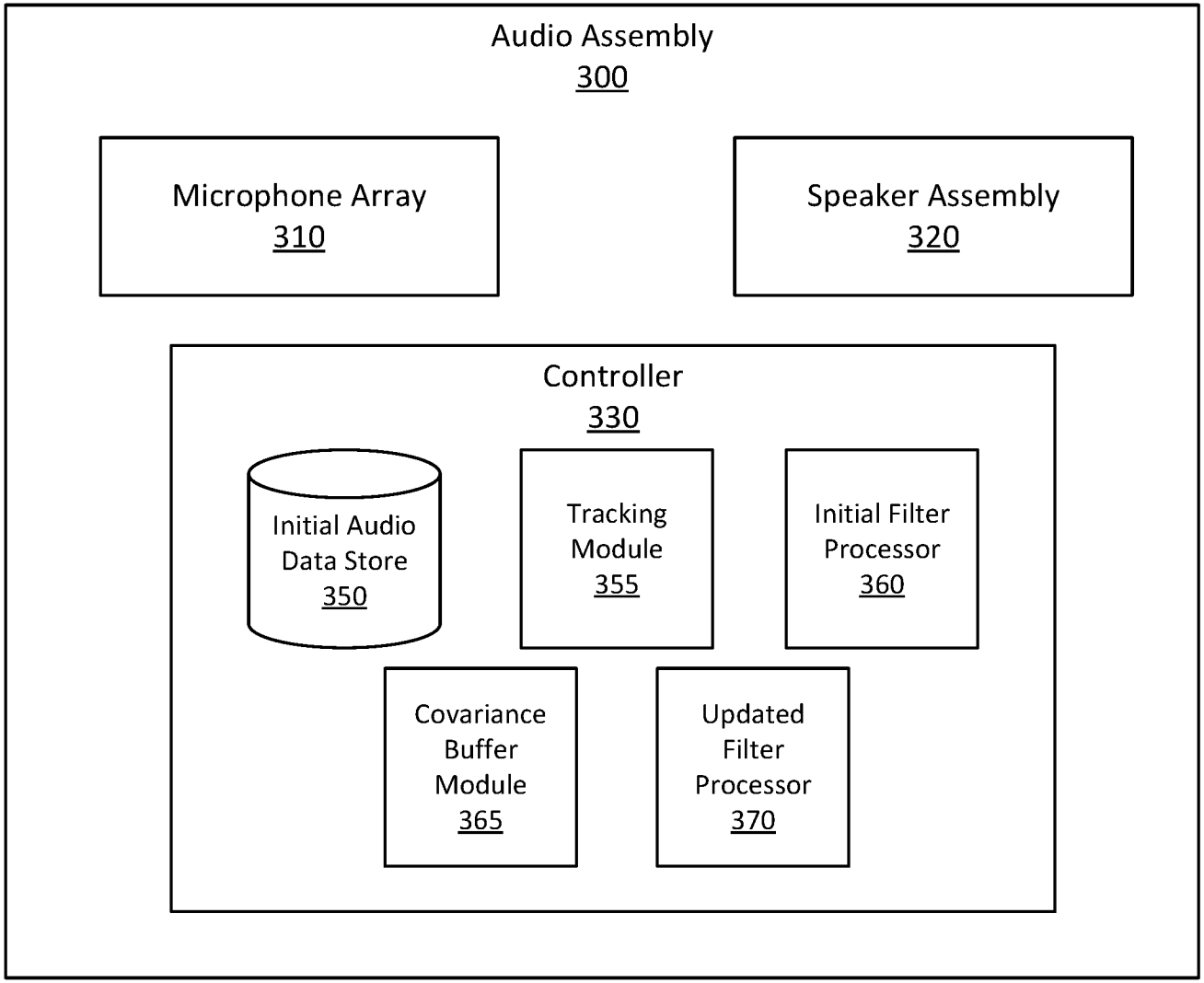
FIG. 3 is a block diagram of an audio assembly, according to one or more embodiments.

FIG. 3 is a block diagram of an audio assembly 300, according to one or more embodiment. The audio assembly 300 adaptively updates signal enhancement filters to generate enhanced signal data for one or more detected audio signals. The audio assembly 300 includes a microphone array 310, a speaker assembly 320, and a controller 330. However, in other embodiments, the audio assembly 300 may include different and/or additional components. Similarly, in some cases, functions can be distributed among the components in a different manner than is described here. The audio assemblies described with reference to FIGS. 1 and 2 are embodiments of the audio assembly 300.

The microphone array 310 detects microphone recordings of audio signals emitted from an audio sources at various positions within a local area of the audio assembly 300. The microphone array 310 comprises a plurality of acoustics sensors which record microphone recordings of one or more audio signals emitting from one or more audio sources. In some embodiments, the microphone array 310 records audio frames, each describing the audio signals emitted and the audio sources active at a given timestamp. The microphone array 310 may process recordings from each acoustic sensor into a complete recording of the audio signals As described above, the microphone array 310 records microphone signals over consecutive timestamps. The recorded information is stored in areas of memory referred to as "bins." In some embodiments, the recorded microphone signal performs direction of arrival (DOA) analysis for each detected audio signal to generate an estimated position of an audio source relative to an audio assembly. The determined DOA may further be implemented in generating filters for playing back audio signals based on enhanced signal data. The microphone array 310 may additionally perform tracking analysis based on an aggregate of the DOA analysis performed over time and estimates of each DOA to determine a statistical representation of a location of an audio source within an environment. Alternatively, the microphone array 310 may perform a source classification for the human and non-human type audio sources. In embodiments in which a user selects, for example via a user interface, one or more audio sources in which they are interested, not interested, or a combination thereof, the microphone array 310 may classify the selected audio sources. In an additional embodiment, data used to initialize the initial filter processor 360 may be personalized to improve the initialization process. For such a process, the microphone array 310 may measure the personal ATF's of a user using a measurement system, for example a camera system.

The speaker assembly 320 presents audio content to a user operating the audio assembly 300. The speaker assembly 320 includes a plurality of speakers that present audio content to the user in accordance with instructions from the controller 330. The presented audio content is based in part on enhanced signal data generated by the controller 330. A speaker may be, e.g., a moving coil transducer, a piezoelectric transducer, some other device that generates an acoustic pressure wave using an electric signal, or some combination thereof. In some embodiments, the speaker assembly 320 also includes speakers that cover each ear (e.g., headphones, earbuds, etc.). In other embodiments, the speaker assembly 320 does not include any acoustic emission locations that occlude the ears of a user.

The controller 330 processes recordings received from the microphone array 310 into enhanced audio signals. The controller 330 generates enhanced signal data based on the microphone signals recorded by the microphone array 310.

The controller 330 comprises an initial audio data store 350, a tracking module 355, an initial filter processor 360, a covariance buffer module 365, and an updated filter processor 370. However, in other embodiments, the controller 300 may include different and/or additional components. Similarly, in some cases, functions can be distributed among the components in a different manner than is described here. For example, some or all of the functionality of the controller 300 may be performed by a local controller 125.

The initial audio data store 350 stores information used by the audio assembly 310. The information may be recorded by the microphone array 310. In one embodiment, the initial audio data store 350 stores, a location of one or more audio sources relative to a headset, a location of one or more audio sources in a local area of the headset, a virtual model of the local area, audio signals recorded from a local area, audio content, transfer functions for one or more acoustic sensors, array transfer functions for the microphone array 310, types of sound sources, head-related transfer functions of the user, a number of audio sources within a local area of the headset, or some combination thereof. Types of sounds may be, e.g., human type (e.g., a person talking on a phone) or non-human type (e.g., a fan, an air-conditioning unit, etc.). A type of sound associated with an audio signal may be based on an estimation of the array transfer function associated with the audio signal. For certain types of sound, for example human audio, the audio assembly 300 enhance the audio signal, whereas for other types of sound, for example non-human type, the audio assembly 300 may maintain the audio signal at its recorded strength instead of enhancing it. Alternatively, the audio assembly 300 may suppress signals which are not of interest from the recorded set of signals such that only audio signals of interest remain. In addition to suppressing audio signals which are not of interest, the audio assembly 300 may also remove such signals from the recorded set.

In some embodiments, the tracking module 355 determines the location of an audio source and the count of audio sources. In some embodiments, the determination is based on the direction of arrival of audio signals emitted from each audio source and a pre-determined tracking algorithm. The tracking module 355 may perform direction of arrival analysis based on the audio signals recorded by the microphone array. In other embodiments, the tracking module 355 generates a tracking algorithm over time by training a machine learned model using a training data set. Similarly, the initial audio data store 350 may receive an ATF determined based on a pre-computed or machine learned ATF-estimation algorithm. The received ATF's may be specific to individual audio sources, for example based on measurements or recordings determined for individual audio sources, or generally applicable for an environment, for example based on KNOWLES ELECTRONIC MANIKIN FOR ACOUSTIC RESEARCH (KEMAR) ATF/RTF measurements, an average human ATF/RTF measurement over different humans operating the audio assembly 300, or anechoic ATF/RTF measurements.

In another embodiment, the tracking module 355 maintains a virtual model of the local area and then updates the virtual model based on an absolute position of each audio source in an environment, a relative position of each audio source to the audio assembly, or a combination of both. Based on the determined ATF's, the tracking module 355 generates head-related transfer functions (HRTF's). In combination with the enhanced signal data, the tracking module 355 filters an audio signal with an HRTF determined by the location of the audio source(s) of interest before reproducing the audio signal for presentation to the user.

The initial filter processor 360 accesses ATF's stored within the initial audio data store 350 to generate an initial signal enhancement filter for each detected audio source, for example a minimum-variance distortionless-response (MVDR) filter, linearly-constrained minimum-variance (LCMV) filter, matched filter, maximum directivity or maximum signal-to-noise ratio (SNR) signal enhancer. In some embodiments, the initial filter processor 360 enhances detected audio signals by implementing beamforming techniques to produce enhanced signal data in the form of beamformed signal data. In one embodiment, the initial filter processor 360 determines a relative transfer function (RTF). To determine an RTF, the initial filter processor 360 may normalize an accessed ATF for each audio source to an arbitrary, but consistent, microphone sensor on the array, for example a microphone sensor expected to have a high SNR in most environments. In some embodiments, the initial filter processor 360 initializes a covariance buffer based on one or more isotropic covariance matrices. Each isotropic covariance matrix is associated with a respective audio source and one or more RTF's recorded by an audio assembly 300 from all directions. An isotropic noise covariance assumes sounds from all directions and is initialized using the recorded RTF's. In some embodiments, the isotropic covariance matrix is computed by summing all RTF covariances recorded by the audio assembly 300.

In one embodiment, the initial filter processor 360 computes individual values stored within the initialized covariance buffer to generate a signal enhancement filter for each of the one or more audio sources, for example minimum-variance distortionless-response (MVDR) filter, linearly-constrained minimum-variance (LCMV) filter, matched filter, maximum directivity or maximum signal-to-noise ratio (SNR) signal enhancer. The result is a signal enhancer pointed in the direction of an audio source relative to the audio assembly. The generated MVDR signal enhancer and covariance buffers used to generate the signal enhancement filter are stored by the initial filter processor 360. Using the generated signal enhancement filter associated with an audio source, the initial filter processor 360 determines enhanced signal data for the audio source by enhancing the audio signal originating from the audio source. The initial filter processor 360 may determine enhanced signal data by enhancing frames of an audio signal emitted from the audio source to which the signal enhancement filter is directed to. In embodiments in which the audio assembly has not yet been initialized, initial filter processor initializes a signal enhancement filter associated with one or more audio sources in the environment using ATF's associated with those audio sources and the process described above.

The covariance buffer module 365 determines a relative contribution of each of the audio sources by building a spatial correlation matrix for each time-frequency bin based on the enhanced signal data generated by the initial filter processor 360 and solving the set of equations associated with the spatial correlation matrix. In other embodiments, the covariance buffer module 365 determines the relative contribution based on a level of power associated with the enhanced signal data. In such embodiments, the covariance buffer module 365 equalizes the power in the enhanced signals to that of the signal enhancer algorithm's power when excited by noise signals associated with the microphone array 310. The covariance buffer module 365 normalizes the equalized power level to the total power over enhanced signal data for all audio sources.

The relative contribution of each audio source characterizes the fraction of the overall audio for the environment for which individual audio source are responsible. The covariance buffer module 365 identifies one or more time-frequency bins for the detected audio signals. For each time-frequency bin, the covariance buffer module 365 determines the relative contribution of each audio source. In such an implementation, the covariance buffer module 365 may implement a model which performs a mean contribution across a range of frequencies. The maximum frequency in the range may be the frequency at which the microphone array begins to cause spatial aliasing and the minimum frequency in the range may be the frequency where the average signal power is equivalent to the white noise gain (WNG) of the updated signal enhancement filter. Accordingly, the relative contribution may be determined on a per-time frequency bin basis before being averaged over the range of frequencies.

In another embodiment, the spatial correlation matrix is used in such a way that the covariance buffer module 365 removes an estimated power contamination from each source from all other source estimates. To do so, the covariance buffer module 365 solves a set of simultaneous equations associated with a spatial correlation matrix to determine the relative acoustic contribution for each audio source given the known expected power coming from all other audio sources in an environment.

For each time-frequency bin, the enhanced signal data generated by the initial filter processor 360 correlates with the signal enhancement filter generated by the initial filter processor 360. The degree to which an enhanced signal correlates with the generated filter is representative of the relative contribution of the audio source. In some embodiments, the covariance buffer module 365 normalizes the estimated relative contributions of each detected audio source based on low energy frames of an audio signal corresponding to each audio source. Low energy frames may also be referred to as "no-signal" frames.

For each detected audio source, the covariance buffer module 365 generates a spatial covariance matrix based on the microphone signal recorded by the microphone array 310. In some embodiments, the spatial covariance matrices are used to determine RTF's for each audio source, for example using Eigen-value decomposition. Each spatial covariance matrix is weighted by the relative acoustic contribution of the audio source. The covariance buffer module 365 assigns a weight to each spatial covariance matrix based on the relative contribution of the audio source for each time-frequency bin. For example, an audio source determined to have a relative contribution of 0.6 is assigned a greater weight than an audio source with a relative contribution of 0.1. In some embodiments, the weight assigned to an audio source is proportional to the relative contribution of the audio source.

The covariance buffer module 365 adds each weighted spatial covariance matrix to a historical covariance buffer comprised of spatial covariance matrices computed for previous iterations of signal enhancement performed by the controller 330. The covariance buffer module 365 ranks the spatial covariance matrices generated for each audio source with a plurality of existing covariance matrices included in the covariance buffer. The ranking of the covariance buffers may be based on the relative acoustic contributions associated with each matrix. From the ranked list of covariance matrices, the covariance buffer module 365 identifies one or more matrices with the lowest assigned relative contributions. In one embodiment, the covariance buffer module 365 updates the covariance buffer by removing the lowest ranked covariance matrix from the covariance buffer. The covariance buffer module 365 may remove a number of matrices from the buffer equivalent or proportional to the number of matrices added to the buffer during the same iteration. In alternate embodiments, the covariance buffer module 365 removes a predetermined number of matrices. Alternatively, the covariance buffer module 365 may update the covariance buffer with covariance matrices assigned relative contributions greater than the lowest relative contributions assigned to existing matrices stored in the buffer.

In some embodiments, the covariance buffer module 365 updates the covariance buffer with a generated spatial covariance matrix based on a comparison of the generated spatial covariance matrix with matrices already in the covariance buffer. The covariance buffer module 365 may update the covariance buffer when the microphone array 310 detects, with a high confidence, a single audio signal from a single audio source. Such a detection may be determined using a singular-value decomposition or by comparing the relative contributions determined for each audio source to a threshold contribution level. In other embodiments, the covariance buffer module 365 does not update the covariance buffer when the microphone array 310 detects no audio sources to be in the local area surrounding the audio assembly 300. Such a detection may be determined by solving an aggregate spatial covariance matrix for a set of audio frames recorded by the microphone array 310 and comparing the mean matrix to a threshold based on the number of audio sources determined to be present, as stored in the initial audio data store 310. For example, a low value of the solved spatial covariance matrix is associated with no audio sources active in an audio frame, whereas a high value may be associated with one or more audio sources emitting audio signals. Alternatively, the value may be determined by comparing the spatial covariance matrix with that of a microphone sensor-noise-only spatial covariance matrix. The more similar the two matrices are, the louder the noise signals within the frame. Similarly, in embodiments with a diffuse field or isotropic field, the covariance buffer module 365 may compare the difference between such spatial covariance matrices.

In some embodiments, the covariance buffer module 365 updates the covariance buffer by removing spatial covariance matrices which have been stored in the buffer for a period of time above a threshold period of time (e.g., buffers above a threshold age). Alternatively, the covariance buffer module 365 may adjust the weights assigned to spatial covariance matrices depending on the length of time that they have been stored in the buffer. For example, the covariance buffer module 365 may decrease the weights assigned to spatial covariance matrices stored longer than the threshold period of time.

For each audio source, the updated filter processor 370 generates an updated signal enhancement filter based on the previously generated signal enhancement filter for the audio source, the updated covariance buffer, or both. In embodiments in which the updated signal enhancement filter is an MVDR, the updated filter processor 370 updates the spatial covariance buffer associated with an audio source determined to be active over a time-frequency bin. For each audio source, the updated filter processor 370 may compute a representative value of the covariance buffer, for example by computing a mean of the buffer over the entries within the buffer, and summing the representative values of each audio source that is not the target of the updated signal enhancement filter. As another example, the updated filter processor 370 may determine a mean contribution for each audio source to which the signal enhancement filter is not directed based on the covariance matrices included in the covariance buffer. For each time-frequency frame, the updated filter processor 370 aggregates the mean contributions to update the signal enhancement filter.

At a subsequent timestamp during which the microphone array detects one or more new audio signals emitting from audio sources, the updated signal enhancement filter replaces the initialized signal enhancement filter generated by the initial filter processor 360. Alternatively, an updated initial signal enhancement filter which may be different to that of the final signal enhancement filter may replace the initialized signal enhancement filter. More specifically, using the updated signal enhancement filter, the initial filter processor 360 generates updated enhanced signal data representative of a detected audio signal by applying the initial signal enhancement filter to frames of an audio signal recorded by the microphone array 310. Accordingly, in one embodiment, the enhanced signal data generated by the updated filter processor 370 is a plurality of frames representative of the enhanced signal. In additional embodiments, the updated filter processor 370 computes an updated RTF for each audio source, for example using Eigenvalue decomposition on each of the sample covariance matrices computed from the covariance buffer for a given audio source.

In some embodiments, the controller 330 generates instructions based on updated signal data which cause the speaker assembly 320 to perform actions. For example, the controller 300 may generate instructions to enhance an audio signal, i.e., human type, emitted from a person communicating with a user operating the audio assembly 300 relative to other audio signals recording non-human type from the surrounding environment. Accordingly, the speaker array 320 presents to the user of the audio assembly an enhanced audio signal. In some embodiments, the controller 330 identifies which signals to enhance based on eye-tracking data received from the headset 100, for example using the techniques described above with reference to FIG. 2. In some embodiments, the speaker assembly 320 provides information characterizing the transfer function such the controller 330 may remove feedback signals or echo sounds.

Figure 4:
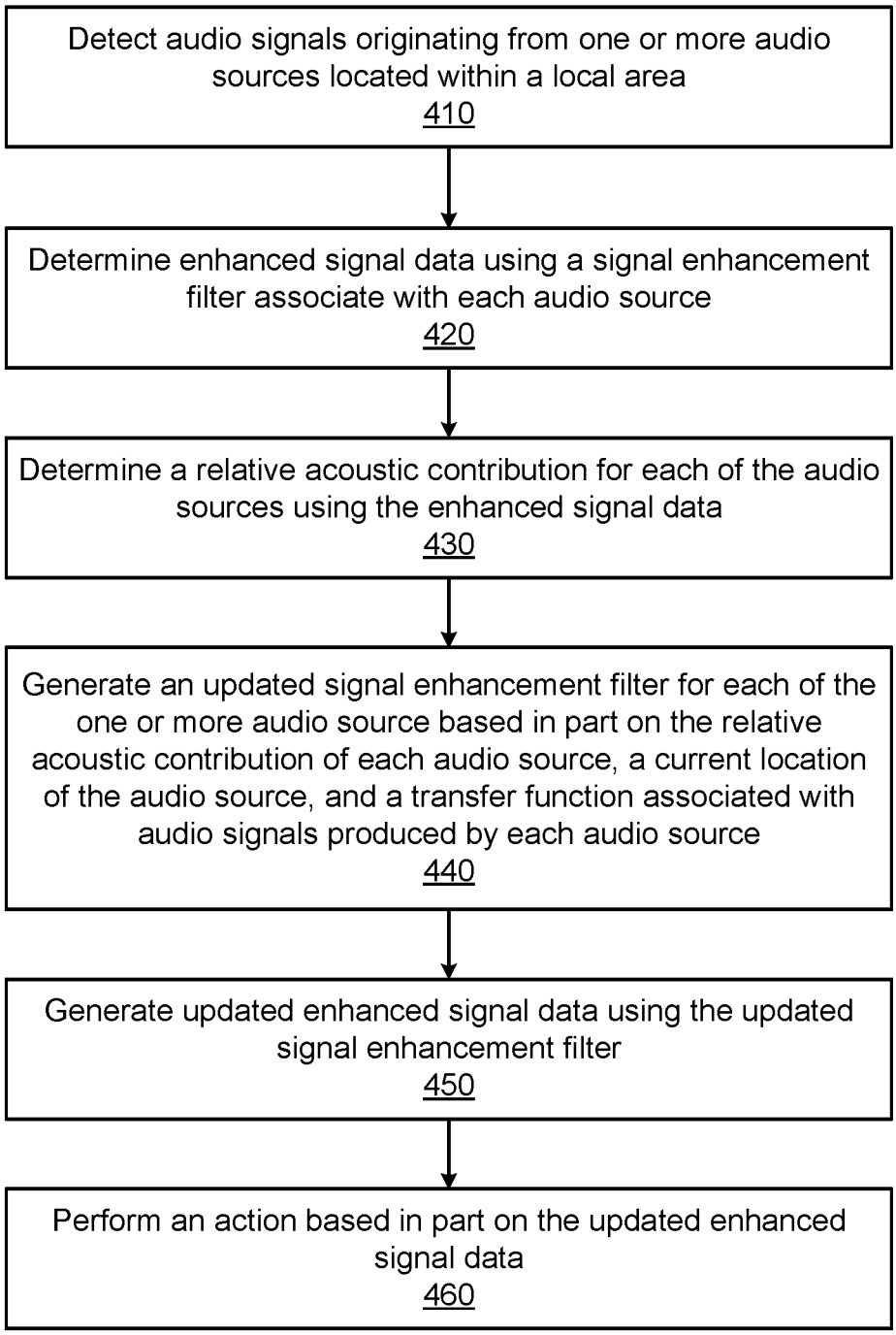
FIG. 4 is a flowchart illustrating the process of determining enhanced signal data using an audio assembly, according to one or more embodiments.

FIG. 4 is a flowchart illustrating the process of determining enhanced signal data using an audio assembly, according to one or more embodiments. In one embodiment, the process of FIG. 4 is performed by an audio assembly (e.g., the audio assembly 300). Other entities may perform some or all of the steps of the process in other embodiments (e.g., a console). Likewise, embodiments may include different and/or additional steps or perform the steps in different orders.

The audio assembly 300 detects 410 audio signals originating from one or more audio sources located within a local area of the audio assembly. The audio assembly 300 may detect the audio signals using the microphone array 310. The microphone array 310 detects audio signals over one or more timestamps, or time-frequency bins. For each detected audio signal, the microphone array 310 records a microphone signal to be processed by the controller. The microphone signal and additional information describing the surrounding environment or local area are stored within the initial audio data store 350. In alternate embodiments, the audio assembly receives audio signals from a microphone assembly that is external to the audio assembly (i.e., a microphone assembly positioned separate from the audio assembly).

The audio assembly 300 determines 420 enhanced signal data using a signal enhancement filter associated with each audio source. In embodiments in which the audio system has not previously determined enhanced signal data, the initial filter processor 360 initializes a signal enhancement filter for each audio source based on an RTF (e.g., the normalized ATF's) for the audio source. During subsequent iterations, the initial filter processor 360 determines enhanced signal data using the most updated signal enhancement filter from preceding iterations and the current iteration.

The audio assembly 300 determines 430 a relative acoustic contribution of each of the audio sources using the enhanced signal data. In some embodiments, the covariance buffer module 365 computes a set of simultaneous equations associated with a spatial correlation matrix to determine the relative contribution of an audio source detected within a time-frequency bin. The covariance buffer module 365 updates a buffer of spatial covariance matrices with spatial covariance matrices associated with the detected audio sources and weights each covariance matrix based on the determined relative contribution of the audio source for the given time-frequency bin.

The audio assembly 300 generates 440 an updated signal enhancement filter for each of the one or more audio sources based in part on the relative acoustic contribution of each audio source, a current location of each audio source, and a transfer function (i.e., ATF or RTF) associated with audio signals produced by each audio source. The updated signal enhancement filter may be determined by determining the expected value of the buffer for each audio source that is not the desired target of the updated signal enhancement filter and then aggregating the determined values, for example summing the determined values. For each frame, time-frequency bin, or combination thereof, the updated filter processor 370 generates an updated signal enhancement filter for each audio source detected in the frame to account for any changes in the spatial position of the audio source relative to the audio assembly.

The audio assembly 300 generates 450 updated enhanced signal data using the updated signal enhancement filter. The updated filter processor 370 directs a beam towards the position of an audio source using the updated signal enhancement filter. The speaker assembly 320 performs an action based in part on the updated enhanced signal data. In one embodiment, the speaker assembly 320 presents enhanced signal data for an audio signal to a user operating the audio assembly. In other embodiments, the speaker assembly 320 may combine the enhanced audio signal with ambient sounds, HRTF's, or a combination thereof before being presented at the original location of the audio source. The audio assembly 300 may also perform active noise cancellation (ANC) processing to reduce ambient noise while the enhanced signal is presented to a user.

Example System Environment

Figure 5:
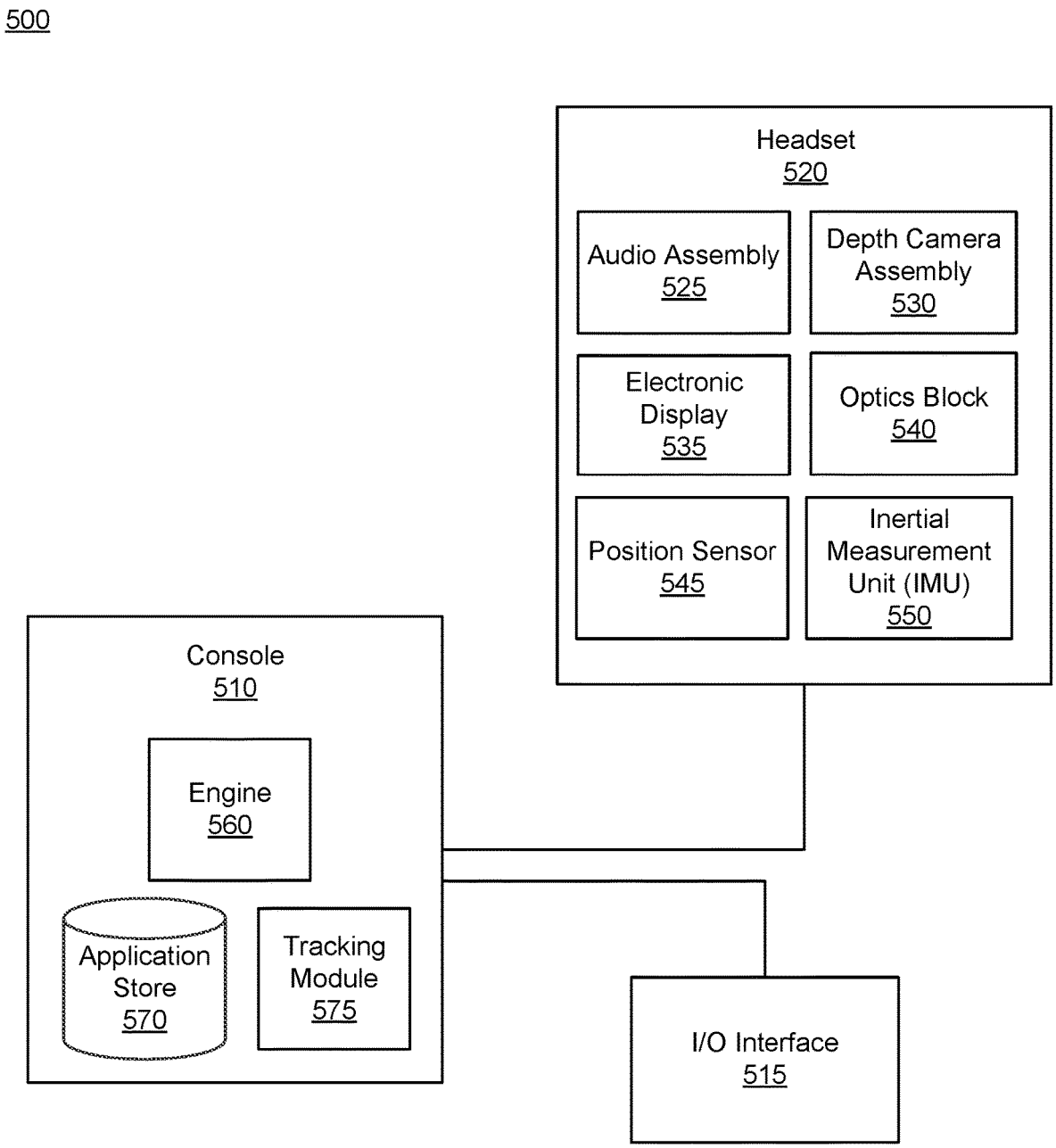
FIG. 5 is a system environment including a headset, according to one or more embodiments.

FIG. 5 is a system environment 500 including a headset, according to one or more embodiments. The system 500 may operate in an artificial reality environment. The system 500 shown in FIG. 5 includes a headset 520, an input/output (I/O) interface 515 that is coupled to a console 510. The headset 520 may be an embodiment of the headset 100. While FIG. 5 shows an example system 500 including one headset 520 and one I/O interface 515, in other embodiments any number of components may be included in the system 600. For example, there may be multiple headsets 520 each having an associated I/O interface 515 communicating with the console 510. In alternative configures, different and/or additional components may be included in the system 500. Additionally, functionality described in conjunction with one or more components shown in FIG. 5 may be distributed among the components in a different manner than described in conjunction with FIG. 5 in some embodiments. For example, some or all of the functionality of the console 510 is provided by the headset 520.

In some embodiments, the headset 520 presents content to a user comprising augmented views of a physical, real-world environment with computer-generated elements (e.g., two dimensional (2D) or three dimensional (3D) images, 2D or 3D video, sound, etc.). In some embodiments, the presented content includes audio content that is generated via an audio analysis system that receives recordings of audio signals from the headsets 520, the console 510, or both, and presents audio content based on the recordings. In some embodiments, each headset 520 presents virtual content to the user that is based in part on a real environment surrounding the user. For example, virtual content may be presented to a user of the headset. The user physically may be in a room, and virtual walls and a virtual floor of the room are rendered as part of the virtual content. In the embodiment of FIG. 5, the headset 520 includes an audio assembly 525, an electronic display 535, an optics block 540, a position sensor 545, a depth camera assembly (DCA) 530, and an inertial measurement (IMU) unit 550. Some embodiments of the headset 520 have different components than those described in conjunction with FIG. 5. Additionally, the functionality provided by various components described in conjunction with FIG. 5 may be distributed differently among the components of the headsets 520 in other embodiments or be captured in separate assemblies remote from the plurality of headsets 520. Functionality described with reference to the components of the headset 520*a* also applies to the headset 520*b*.

In some embodiments, the audio assembly 525 enhances audio signals using signal enhancement techniques performed by a remote controller, for example controller 330, or a local controller, for example local controller 125. The audio assembly 525 is an embodiment of the audio assembly 300 described with reference to FIG. 3. The audio signals are recorded by the audio assembly 525 and processed to generate an updated signal enhancement filter associated with the audio source and the relative position of the audio source and generate updated enhanced signal data using the updated signal enhancement filter. The audio assembly 525 may include a microphone array, a speaker assembly, and a local controller, among other components. The microphone array detects audio signals emitted within a local area of the headset 520 and generates a microphone recording of the detected signals. The microphone array may include a plurality of acoustic sensors that each detected air pressure variations of a sound wave and convert the detected signals into an electronic format. The speaker assembly performs actions based on the generated updated enhanced signal data, for example presenting an enhanced audio signal to a user. The speaker assembly may include a plurality of speakers which convert audio signals from an electronic format into a sound which can be played for a user. The plurality of acoustic sensors and speakers may be positioned on a headset (e.g., headset 100), on a user (e.g., in an ear canal of the user or on the cartilage of the ear), on a neckband, or some combination thereof.

Based on microphone recordings, the audio assembly 525 generates updated enhanced signal data for an audio signal detected in the environment in which the headset 520 is positioned. The audio assembly 525 may update enhanced signal data to enhance the detected audio signal such that the signal can be distinguished from other detected signals. The audio assembly 525 computes a relative contribution of each audio source detected in the microphone recording and generates an updated signal enhancement filter based on a buffer which accounts for the relative contribution of the audio sources. An audio representation of the enhanced signal is presented to a user based on the updated enhanced signal data. The audio assembly 525 may also communicate recordings recorded by the audio assemblies to a remote controller for the recordings to be analyzed. In some embodiments, one or more functionalities of the audio assembly 525 may be performed by the console 510. In such embodiments, the audio assembly 525 may deliver or communicate detected audio signals to the console 510.

The DCA 530 captures data describing depth information for a local area surrounding the headset 520. In one embodiment, the DCA 530 may include a structured light projector, and an imaging device. The captured data may be images captured by the imaging device of structured light projected onto the local area by the structured light projector. In one embodiment, the DCA 530 may include two or more cameras that are oriented to capture portions of the local area in stereo and a controller. The captured data may be images captured by the two or more cameras of the local area in stereo. The DCA 530 computes the depth information of the local area using the captured data. Based on the depth information, the DCA 530 determines absolute positional information of the headset 520 within the local area. The DCA 530 may be integrated with the headset 520 or may be positioned within the local area external to the headset 520. In the latter embodiment, the DCA 530 may transmit the depth information to the audio assembly 525.

The electronic display 535 displays 2D or 3D images to the user in accordance with data received from the console 510. In various embodiments, the electronic display 535 comprises a single electronic display or multiple electronic displays (e.g., a display for each eye of a user). Examples of the electronic display 535 include: a liquid crystal display (LCD), an organic light emitting diode (OLED) display, an active-matrix organic light-emitting diode display (AMOLED), some other display, or some combination thereof. The electronic display 535 may be a waveguide display comprising one or more waveguides in which image light is coupled through an end or edge of the waveguide to the eye of the user. The electronic display 535 provides image light which is directed through a lens or plane from one end of the waveguide display to another.

The optics block 540 magnifies image light received from the electronic display 535, corrects optical errors associated with the image light, and presents the corrected image light to a user of the headset 520. The electronic display 535 and the optics block 540 may be an embodiment of the lens 110. In various embodiments, the optics block 540 includes one or more optical elements. Example optical elements included in the optics block 540 include: an aperture, a Fresnel lens, a convex lens, a concave lens, a filter, a reflecting surface, or any other suitable optical element that affects image light. Moreover, the optics block 540 may include combinations of different optical elements. In some embodiments, one or more of the optical elements in the optics block 540 may have one or more coatings, such as partially reflective or anti-reflective coatings.

Magnification and focusing of the image light by the optics block 540 allows the electronic display 535 to be physically smaller, weigh less, and consume less power than larger displays. Additionally, magnification may increase the field of view of the content presented by the electronic display 535. For example, the field of view of the displayed content is such that the displayed content is presented using almost all (e.g., approximately 110 degrees diagonal), and in some cases all, of the user's field of view. Additionally in some embodiments, the amount of magnification may be adjusted by adding or removing optical elements.

In some embodiments, the optics block 540 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 535 for display is pre-distorted, and the optics block 540 corrects the distortion when it receives image light from the electronic display 535 generated based on the content.

The IMU 550 is an electronic device that generates data indicating a position of the headset 520 based on measurement signals received from one or more position sensors 540. The one or more position sensors 540 may be an embodiment of the sensor device 115. A position sensor 545 generates one or more measurement signals in response to motion of the headset 520. Examples of position sensors 540 include: one or more accelerometers, one or more gyroscopes, one or more magnetometers, another suitable type of sensor that detects motion, a type of sensor used for error correction of the IMU 550, or some combination thereof. The position sensors 540 may be located external to the IMU 550, internal to the IMU 550, or some combination thereof.

Based on the one or more measurement signals from one or more position sensors 540, the IMU 550 generates data indicating an estimated current position of the headset 520 relative to an initial position of the headset 520. For example, the position sensors 540 include multiple accelerometers to measure translational motion (forward/back, up/down, left/right) and multiple gyroscopes to measure rotational motion (e.g., pitch, yaw, and roll). In some embodiments, the IMU 550 rapidly samples the measurement signals and calculates the estimated current position of the headset 520 from the sampled data. For example, the IMU 550 integrates the measurement signals received from the accelerometers over time to estimate a velocity vector and integrates the velocity vector over time to determine an estimated current position of a reference point on the headset 520. Alternatively, the IMU 550 provides the sampled measurement signals to the console 510, which interprets the data to reduce error. The reference point is a point that may be used to describe the position of the headset 520. The reference point may generally be defined as a point in space or a position related to the headset 520 orientation and position. In some embodiments, the IMU 550 and the position sensor 545 may function as a sensor device (not shown).

The I/O interface 515 is a device that allows a user to send action requests and receive responses from the console 510. An action request is a request to perform a particular action. For example, an action request may be an instruction to start or end capture of image or video data, start or end the audio analysis system 300 from recording sounds, start or end a calibration process of the headset 520, or an instruction to perform a particular action within an application. The I/O interface 515 may include one or more input devices. Example input devices include: a keyboard, a mouse, a game controller, or any other suitable device for receiving action requests and communicating the action requests to the console 510. An action request received by the I/O interface 515 is communicated to the console 510, which performs an action corresponding to the action request. In some embodiments, the I/O interface 510 includes an IMU 540, as further described above, that captures calibration data indicating an estimated position of the I/O interface 515 relative to an initial position of the I/O interface 515. In some embodiments, the I/O interface 515 may provide haptic feedback to the user in accordance with instructions received from the console 510. For example, haptic feedback is provided when an action request is received, or the console 510 communicates instructions to the I/O interface 515 causing the I/O interface 515 to generate haptic feedback when the console 510 performs an action.

The console 510 provides content to the headset 520 for processing in accordance with information received from one or more of: the plurality of headsets 520 and the I/O interface 515. In the example shown in FIG. 5, the console 510 includes an application store 570, a tracking module 575, and an engine 560. Some embodiments of the console 510 have different modules or components than those described in conjunction with FIG. 5. Similarly, the functions further described below may be distributed among components of the console 510 in a different manner than described in conjunction with FIG. 5.

The application store 570 stores one or more applications for execution by the console 540. An application is a group of instructions, that when executed by a processor, generates content for presentation to the user. Content generated by an application may be in response to inputs received from the user via movement of the headset 520 or the I/O interface 515. Examples of applications include: gaming applications, conferencing applications, video playback applications, calibration processes, or other suitable applications.

The tracking module 575 calibrates the system environment 500 using one or more calibration parameters and may adjust one or more calibration parameters to reduce error in determination of the position of the headset 520 or of the I/O interface 515. Calibration performed by the tracking module 575 also accounts for information received from the IMU 540 in the headset 520 and/or an IMU 540 included in the I/O interface 515. Additionally, if tracking of the headset 520 is lost, the tracking module 575 may re-calibrate some or all of the system environment 500.

The tracking module 575 tracks movements of the plurality of headsets 520 or of the I/O interface 515 using information from the one or more sensor devices 535, the IMU 540, or some combination thereof. For example, the tracking module 575 determines a position of a reference point of the headset 520 in a mapping of a local area based on information from the headset 520. The tracking module 575 may also determine positions of the reference point of the headset 520 or a reference point of the I/O interface 515 using data indicating a position of the headset 520 from the IMU 540 or using data indicating a position of the I/O interface 515 from an IMU 550 included in the I/O interface 515, respectively. Additionally, in some embodiments, the tracking module 575 may use portions of data indicating a position or the headset 520 from the IMU 540 to predict a future location of the headset 520. The tracking module 575 provides the estimated or predicted future position of the headset 520 or the I/O interface 515 to the engine 560.

The engine 560 also executes applications within the system environment 500 and receives position information, acceleration information, velocity information, predicted future positions, audio information, or some combination thereof of the plurality of headsets 520 from the tracking module 575. Based on the received information, the engine 560 determines content to provide to the plurality of headsets 520 for presentation to the user. For example, if the received information indicates that the user has looked to the left, the engine 560 generates content for the plurality of headsets 520 that mirrors the user's movement in a virtual environment or in an environment augmenting the local area with additional content. Additionally, the engine 560 performs an action within an application executing on the console 510 in response to an action request received from the I/O interface 515 and provides feedback to the user that the action was performed. The provided feedback may be visual or audible feedback via the plurality of headsets 520 or haptic feedback via the I/O interface 515.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

detecting audio signals with a microphone array, the audio signals originating from one or more audio sources located within a local area, wherein each of the one or more audio sources is associated with a respective signal enhancement filter;

determining enhanced signal data using the signal enhancement filters associated with each of the one more audio sources;

determining a relative acoustic contribution of each of the one or more audio sources using the enhanced signal data;

generating an updated signal enhancement filter for each of the one or more audio sources, the generation for each audio source based in part on the relative acoustic contribution of the audio source, a current location of the audio source, and a transfer function associated with audio signals produced by the audio source;

generating updated enhanced signal data using the updated signal enhancement filters; and performing an action based in part on the updated enhanced signal data.

2. The method of claim 1, wherein determining the enhanced signal data using the signal enhancement filters associated with each of the one or more audio sources, comprises:

normalizing an array transfer function (ATF) for each of the one or more audio sources into a relative transfer function (RTF) for the audio source;

initializing a covariance buffer based on one or more isotropic covariance matrices, wherein each isotropic covariance matrix is associated with a set of RTF's normalized for the audio source;

generating a signal enhancement filter for each of the one or more audio sources based on the initialized covariance buffer and the set of RTF's; and determining, for each of the one or more audio sources, the enhanced signal data by enhancing an audio signal originating from the audio source using the generated signal enhancement filter associated with the audio source.

3. The method of claim 1, wherein determining the relative acoustic contribution for each of the one or more audio sources comprises:

identifying one or more time-frequency bins for the detected audio signals; and for each time-frequency bin, determining a mean contribution across a range of frequencies to determine the relative acoustic contribution for each of the one or more audio sources.

4. The method of claim 3, wherein determining the relative acoustic contribution for each of the one or more audio sources comprises:

equalizing the estimated relative acoustic contribution based on low energy frames of an audio signal corresponding to each of the one or more audio sources.

5. The method of claim 1, wherein generating the updated signal enhancement filter for each of the one or more audio sources comprises:

generating, for each of the one or more audio sources, a spatial covariance matrix, wherein each spatial covariance matrix is weighted by the relative acoustic contribution of the audio source;

updating a covariance buffer with the generated spatial covariance matrix based on a comparison of the generated spatial covariance matrix with matrices in the covariance buffer; and generating, for each of the one or more audio sources, an updated signal enhancement filter based on the updated covariance buffer.

6. The method of claim 5, wherein updating the covariance buffer with the generated spatial covariance matrix comprises:

ranking spatial covariance matrices generated for each of the one or more audio sources with a plurality of existing covariance matrices included in the covariance buffer, the ranking based on the relative acoustic contributions of the audio source associated with each matrix; and updating the covariance buffer by removing the lowest ranked covariance matrix from the covariance buffer.

7. The method of claim 5, wherein generating, for each of the one or more audio sources, the updated signal enhancement filter based on the updated covariance buffer comprises:

determining, for each of the one or more audio sources to which the signal enhancement filter is not directed, a mean contribution for the audio source based on the covariance matrices included in the covariance buffer; and aggregating, for each of the one or more audio sources, the mean contributions to update the signal enhancement filter.

8. An audio assembly comprising:

a microphone assembly configured to detect audio signals with a microphone array, the audio signals originating from one or more audio sources located within a local area, wherein each of the one or more audio sources is associated with a respective signal enhancement filter;

a controller configured to:

determine enhanced signal data using the signal enhancement filters associated with each of the one or more audio sources;

determine a relative acoustic contribution of each of the one or more audio sources using the enhanced signal data;

generate updated signal enhancement filters for each of the one or more audio sources, the generation for each audio source based in part on the relative acoustic contribution of the audio source, a current location of the audio source, and a transfer function associated with audio signals produced by the audio source;

generate updated enhanced signal data using the updated signal enhancement filters; and a speaker assembly configured to perform an action based in part on the updated enhanced signal data.

9. The audio assembly of claim 8, wherein the controller is further configured to:

normalize an array transfer function (ATF) for each of the one or more audio sources into a relative transfer function (RTF);

initialize a covariance buffer based on one or more isotropic covariance matrices, wherein each isotropic covariance matrix is associated with a set of RTF's normalized for the audio source;

generate a signal enhancement filter for each of the one or more audio sources based on the initialized covariance buffer and the set of RTF's; and determine, for each of the one or more audio sources the enhanced signal data by directing a beam towards an estimated location for the audio source using the generated signal enhancement filter associated with the audio source.

10. The audio assembly of claim 8, wherein the controller is further configured to:

identify one or more time-frequency bins for the detected audio signals; and for each time-frequency bin, determine a mean contribution across a range of frequencies to determine the relative acoustic contribution for each of the one or more audio sources.

11. The audio assembly of claim 10, wherein the controller is further configured to:

determine an estimated relative acoustic contribution of each audio source; and equalize the estimated relative acoustic contribution based on low energy frames of an audio signal corresponding to each of the one or more audio sources.

12. The audio assembly of claim 8, wherein the controller is further configured to:

generate, for each of the one or more audio sources, a spatial covariance matrix, wherein each spatial covariance matrix is weighted by the relative acoustic contribution of the audio source;

update a covariance buffer with the generated spatial covariance matrix based on a comparison of the generated spatial covariance matrix with matrices already included in the covariance buffer; and generate, for each of the one or more audio sources, the updated signal enhancement filter based on the updated covariance buffer.

13. The audio assembly of claim 12, wherein the controller is further configured to:

rank the spatial covariance matrices generated for each of the one or more audio sources with a plurality of existing covariance matrices included in the covariance buffer, the ranking based on the relative acoustic contributions associated with each matrix; and update the covariance buffer by removing the lowest ranked covariance matrix from the covariance buffer.

14. The audio assembly of claim 12, wherein the controller is further configured to:

rank the spatial covariance matrices generated for each of the one or more audio sources with a plurality of existing covariance matrices included in the covariance buffer, the ranking based on a period of time which each covariance matrix has been stored in the covariance buffer; and update the covariance buffer by removing covariance matrices which have been stored in the buffer for a period of time above a threshold period.

15. The audio assembly of claim 12, wherein the controller is further configured to:

determine, for each of the one or more audio sources that is not a desired target of the updated signal enhancement filter, a mean contribution for each audio source based on the covariance matrices included in the covariance buffer; and aggregate, for each time-frequency frame, the mean contributions to update the signal enhancement filter.

16. The audio assembly of claim 8, wherein the audio assembly is embedded into a headset worn by a user.

17. A non-transitory computer readable storage medium comprising computer program instructions that when executed by a computer processor cause the processor to:

detect audio signals with a microphone array, the audio signals originating from one or more audio sources located within a local area, wherein each of the one or more audio sources is associated with a respective signal enhancement filter;

determine enhanced signal data using the signal enhancement filters associated with each of the one or more audio sources;

determine a relative acoustic contribution of each of the one or more audio sources using the enhanced signal data;

generate an updated signal enhancement filter for each of the one or more audio sources, the generation for each audio source based in part on the relative acoustic contribution of the audio source, a current location of the audio source, and a transfer function associated with audio signals produced by the audio source;

generate updated enhanced signal data using the updated signal enhancement filters; and perform an action based in part on the updated enhanced signal data.

18. The non-transitory computer readable storage medium of claim 17, wherein the computer program instructions further cause the processor to:

normalize an array transfer function (ATF) for each of the one or more audio sources into a relative transfer function (RTF) for the audio source;

initialize a covariance buffer based on one or more isotropic covariance matrices, wherein each isotropic covariance matrix is associated with set of RTF's normalized for the audio source;

generate a signal enhancement filter for each of the one or more audio sources based on the initialized covariance buffer and the set of RTF's; and determine, for each of the one or more audio sources, the enhanced signal data by enhancing an audio signal originating from the audio source using the generated signal enhancement filter associated with the audio source.

19. The non-transitory computer readable storage medium of claim 17, wherein the computer program instructions further cause the processor to:

identify one or more time-frequency bins for the detected audio signals; and for each time-frequency bin, solve a set of simultaneous equations associated with a spatial correlation matrix to determine the relative acoustic contribution for each of the one or more audio sources.

20. The non-transitory computer readable storage medium of claim 17, wherein the computer program instructions further cause the processor to:

generate, for each of the one or more audio sources, a spatial covariance matrix, wherein each spatial covariance matrix is weighted by the relative acoustic contribution of the audio source;

update a covariance buffer with the generated spatial covariance matrix based on a comparison of the generated spatial covariance matrix with matrices in the covariance buffer; and generate, for each of the one or more audio sources, an updated signal enhancement filter based on the updated covariance buffer.

* * * * *